US010999692B2

(12) United States Patent
Kim et al.

(10) Patent No.: US 10,999,692 B2
(45) Date of Patent: May 4, 2021

(54) AUDIO DEVICE, AUDIO SYSTEM, AND METHOD FOR PROVIDING MULTI-CHANNEL AUDIO SIGNAL TO PLURALITY OF SPEAKERS

(71) Applicant: LG ELECTRONICS INC., Seoul (KR)

(72) Inventors: Tae Young Kim, Seoul (KR); Tae Jin Park, Yongin-si (KR); Si Jin Kim, Hwaseong-si (KR); Eun Jung Lee, Seoul (KR); Soon Hyung Hwang, Seoul (KR); Hyo Rim Kim, Gunpo-si (KR); Min Jae Kim, Seoul (KR); Hyo Sung Kim, Daegu (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/737,713

(22) Filed: Jan. 8, 2020

(65) Prior Publication Data

US 2020/0336857 A1 Oct. 22, 2020

(30) Foreign Application Priority Data

Apr. 17, 2019 (KR) ..... 10-2019-0045082

(51) Int. Cl.
*H04R 5/02* (2006.01)
*H04S 7/00* (2006.01)
(Continued)

(52) U.S. Cl.
CPC ..... *H04S 7/301* (2013.01); *H04R 5/02* (2013.01); *H04R 5/04* (2013.01); *H04S 3/008* (2013.01);
(Continued)

(58) Field of Classification Search
CPC ..... H04S 7/301; H04S 3/008; H04R 5/02; H04R 5/04
See application file for complete search history.

(56) References Cited

U.S. PATENT DOCUMENTS

2002/0054685 A1* 5/2002 Avendano ..... H04M 9/082 381/66
2002/0136414 A1* 9/2002 Jordan ..... H04S 3/00 381/58
(Continued)

FOREIGN PATENT DOCUMENTS

EP 3 416 411 A1 1/2007
EP 3 214 858 A1 9/2017
(Continued)

*Primary Examiner* — Simon King
(74) *Attorney, Agent, or Firm* — Birch, Stewart, Kolasch & Birch, LLP

(57) ABSTRACT

The audio device according to the present disclosure may include a mixer that adjusts the number of channels of an inputted audio signal based on the number of speakers connected, a transmitter that transmits a test audio signal for speaker setup, to at least one speaker among the plurality of speakers, a feedback receiver that receives a signal of the outputted audio, a controller that determines an output time difference between the plurality of speakers, based on the signal of the outputted audio, and a post-processor that adds an output delay signal to the audio signal of at least one channel of a multi-channel audio signal provided to the plurality of speakers so as to synchronize the outputs of the plurality of speakers, based on the determined output time difference.

18 Claims, 10 Drawing Sheets

(51) Int. Cl.
*H04R 5/04* (2006.01)
*H04S 3/00* (2006.01)

(52) U.S. Cl.
CPC ..... *H04S 2400/01* (2013.01); *H04S 2400/03* (2013.01); *H04S 2400/15* (2013.01)

(56) References Cited

U.S. PATENT DOCUMENTS

| | | | | |
|---|---|---|---|---|
| 2007/0223874 | A1* | 9/2007 | Hentschel | H04N 21/44008 386/203 |
| 2007/0242834 | A1* | 10/2007 | Coutinho | H04R 5/04 381/71.8 |
| 2009/0290064 | A1* | 11/2009 | Matsumoto | H04N 21/4307 348/515 |
| 2018/0192223 | A1* | 7/2018 | Satheesh | H04S 7/305 |

FOREIGN PATENT DOCUMENTS

| | | | |
|---|---|---|---|
| EP | 3 565 279 | A1 | 11/2019 |
| JP | 2007-13707 | A | 1/2007 |
| KR | 10-0739776 | B1 | 7/2007 |
| KR | 10-2017-0092407 | A | 8/2017 |
| WO | WO 2013/016500 | A1 | 1/2013 |
| WO | WO 2014/040667 | A1 | 3/2014 |
| WO | WO 2018/123612 | A1 | 7/2018 |

* cited by examiner

AUDIO DEVICE, AUDIO SYSTEM, AND METHOD FOR PROVIDING MULTI-CHANNEL AUDIO SIGNAL TO PLURALITY OF SPEAKERS

CROSS-REFERENCE TO RELATED APPLICATION

This present application claims benefit of priority to Korean Patent Application No. 10-2019-0045082, entitled "AUDIO DEVICE, AUDIO SYSTEM, AND METHOD FOR PROVIDING MULTI-CHANNEL AUDIO SIGNAL TO PLURALITY OF SPEAKERS," filed on Apr. 17, 2019, in the Korean Intellectual Property Office, the entire disclosure of which is incorporated herein by reference.

BACKGROUND

1. Technical Field

The present disclosure relates to an audio device, an audio system, and a method for providing a multi-channel audio signal to a plurality of speakers. More specifically, the present disclosure relates to an audio device, an audio system, and a method for enabling synchronization between the outputs of a plurality of speakers to be maintained, while enabling a multi-channel audio system to be built at low cost.

2. Description or Related Art

In accordance with the development of video and audio processing technology, high-definition video and high-quality audio contents are being produced on a large scale.

Content consumers who demand high-definition video and high-quality audio content desire lifelike video and audio, and thus the demand for stereoscopic video and stereophonic sound is increasing.

In order to produce stereophonic sound, a plurality of speakers are arranged at different positions in the listening space, and each speaker outputs the same or a different audio signal such that the listener experiences a sense of space.

In a TV system or an audio system that produces stereophonic sound. a high-performance audio device capable of processing a multi-channel audio signal is required, and a plurality of speakers for outputting multi-channel audio must be additionally provided. Accordingly, implementing such a system involves a high cost.

In addition, in order to harmonize the audio outputted from the plurality of speakers and thereby accurately produce stereophonic sound at the listening position, professional installation techniques are required. Accordingly, additional cost and effort is required to install the equipment.

In this regard, Korean Patent No. 739776 discloses an algorithm and a system for simulating a 5.1 channel surround sound effect with two speakers, using a sound field effect.

However, even if a sound field effect is used, it is still difficult to provide a lifelike stereophonic sound using only two speakers, and a number of speakers corresponding to the number of channels is required in order to produce a lifelike stereophonic effect.

However, in a stereophonic sound system, a plurality of speakers are typically connected by wire, which may lead to a complicated arrangement of cables connecting the audio device and the speakers. Furthermore, the connected speakers can then only be used for the stereophonic sound system, and once installed it is difficult to rearrange the speakers.

In this regard, in Korean Patent Laid-Open Publication No. 2017-0092407, a technology is provided in which a main speaker and a sub-speaker may be detachably attached to each other and are capable of wired or wireless communication with each other, whether or not the speakers are attached may be automatically detected and each speaker may output a different audio signal. and bi-directional communication with an external mobile device is possible.

However. Korean Patent Laid-Open Publication No. 2017-0092407 has no disclosure regarding a method for producing stereophonic sound through a plurality of wired and wireless speakers, and additional research is required in order to provide a stereophonic effect using a combination of wired and wireless speakers.

Thus, despite various attempts in the conventional art, there remains a demand for an audio device capable of providing a realistic stereophonic effect, while allowing a multi-channel audio system to be built at a low cost.

SUMMARY OF THE INVENTION

In order to produce stereophonic sound by providing a multi-channel audio signal to a plurality of speakers, the present disclosure is directed to providing an audio device, an audio system, and a method for implementing a stereophonic sound system using existing wireless speakers, so as to solve the problem in which, since a number of speakers corresponding to the number of channels are additionally required, additional costs are incurred.

Further, the present disclosure is directed to providing an audio system, an audio device, and a method capable of implementing a stereophonic sound system by combining wired and wireless speakers, in order to solve the problem in which there is a complicated arrangement of cables and the possible installation distance is limited due to a plurality of speakers in a stereophonic sound system all being connected by wire.

In addition, the present disclosure is directed to providing an audio system, an audio device, and a method capable of automatically synchronizing the outputs of a plurality of speakers, in order to solve the problem in which, when a plurality of wired or wireless speakers are combined and a multi-channel audio signal is reproduced, an audio output time difference between the speakers is generated.

Furthermore, the present disclosure is directed to providing an audio system, an audio device, and a method capable of automatically adjusting, for each individual channel, an audio signal transmitted to a plurality of speakers, in order to solve the problem wherein the assistance of an expert is required in order to build an audio environment for producing stereophonic sound by providing a multi-channel audio signal to a plurality of speakers.

In addition. the present disclosure is directed to providing an audio system. an audio device. and a method capable of automatically adjusting, for each individual channel, the volume of an audio signal transmitted to a plurality of speakers. in order to solve the problem in which. when a plurality of wired or wireless speakers are combined and a multi-channel audio signal is reproduced, uneven levels of audio output are generated due to differences in performance and specification for each speaker.

In order to solve the above-mentioned problems, an audio device according to an embodiment of the present disclosure may provide a configuration capable of adjusting individual channels of a multi-channel audio signal, using a feedback loop for an audio signal transmitted from the audio device and outputted from a plurality of speakers.

That is, the audio device according this embodiment of the present disclosure enables an output delay between the plurality of speakers to be determined, by adopting a configuration in which the audio device transmits an audio signal to at least one speaker among the plurality of speakers, and when audio is then outputted from at least one speaker among the plurality of speakers, a microphone collects the outputted audio and feeds back the audio to the audio device.

In addition, the audio device according to this embodiment of the present disclosure may include a mixer configured to adjust the number of channels of an inputted audio signal based on the number of speakers connected to the audio device, so that the inputted audio signal produces a stereophonic effect.

Here, when the number of speakers connected to the audio device is equal to the number of channels of the inputted audio signal, the mixer may bypass the inputted audio signal, and when the number of speakers connected to the audio device is different from the number of channels of the inputted audio signal. the mixer may upmix or downmix the inputted audio signal, so that the number of channels of the audio signal is equal to the number of speakers connected to the audio device.

The audio device according to this embodiment of the present disclosure may include a transmitter configured to transmit an audio signal, of which the number of channels has been adjusted by the mixer, to at least one speaker among the plurality of speakers.

The transmitter of the audio device may transmit a test audio signal, which has been preset in a speaker setting mode, to one speaker among the plurality of speakers.

The audio device according to this embodiment of the present disclosure may include a feedback receiver configured to receive, from the microphone that has collected audio outputted by at least one speaker among the plurality of speakers, a signal of the outputted audio.

The audio device according to this embodiment of the present disclosure may include a channel difference determiner configured to determine an output time difference between the plurality of speakers, based on the signal of the outputted audio.

The audio device according to this embodiment of the present disclosure may include a channel difference compensator configured to add an output delay signal to the audio signal of at least one channel of the multi-channel audio signal provided to a plurality of speakers so as to synchronize the outputs of the plurality of speakers, based on the determined output time difference.

In the speaker setting mode of the audio device according to this embodiment of the present disclosure, the transmitter may be configured to transmit the same test audio signal to a first speaker and a second speaker, among the plurality of speakers.

Here, the test audio signal may be a signal having a specific frequency pattern, and the feedback receiver may be configured to receive, from the microphone that has collected the signal of the outputted test audio outputted by the first speaker and the second speaker, a signal of the outputted test audio.

In addition, the channel difference determiner may be configured to determine an output time difference between the first speaker and the second speaker by measuring portions in the signal of the outputted test audio where the signal strength of the specific frequency reaches local maximum values.

In a speaker setting mode of an audio device according to another embodiment of the present disclosure, the transmitter may be configured to transmit a first test audio signal to a first speaker among a plurality of speakers, and a second test audio signal to a second speaker among the plurality of speakers.

Here. the first test audio signal is a signal having a first volume and the second test audio signal is a signal having a second volume. and the first volume and the second volume are different in level from each other, and a feedback receiver may be configured to receive, from a microphone that has collected the test audio outputted by the first speaker and the second speaker, a signal of the outputted test audio.

In addition, a channel difference determiner may be configured to determine an output time difference between the first speaker and the second speaker, by measuring a portion in the signal of the outputted test audio where the gain value changes.

In a speaker setting mode of an audio device according to still another embodiment of the present disclosure, a transmitter may be configured to transmit a test audio signal to a first speaker among a plurality of speakers.

Here, a feedback receiver and the transmitter may be configured to repeat, a predetermined number of times, an operation in which the feedback receiver receives, from a microphone that has collected test audio outputted by the first speaker, a signal of the outputted test audio, and the transmitter transmits the signal of the outputted test audio, received by the feedback receiver, to the first speaker again.

Further, a channel difference determiner may be configured to measure, through said operation, a round-trip latency of the first speaker, and determine an output time difference between the first speaker and a second speaker based on the measured round-trip latency of the first speaker and previously stored data on an output delay time of the second speaker.

In an audio device according to embodiments of the present disclosure, a channel difference compensator may be configured to add, based on a determined output time difference between a first speaker and a second speaker, an output delay signal to an audio signal of a channel, of a multi-channel audio signal, provided to the speaker having a lower output delay among the first speaker and the second speaker, so as to synchronize the outputs of the first speaker and the second speaker.

In a speaker setting mode of an audio device according to yet another embodiment of the present disclosure, a transmitter may be configured to transmit the same test audio signal to a first speaker and a second speaker among a plurality of speakers. at an interval of a first time period.

Here, a feedback receiver may be configured to receive. from a microphone that has collected test audio outputted by the first speaker and the second speaker, a signal of the outputted test audio.

In addition, a channel difference determiner may be additionally configured to determine a volume output difference between the first speaker and the second speaker, based on the difference between the average volume of an initial audio signal and the average volume of a later audio signal, existing after the first time period has elapsed since the starting point of the initial audio signal, in the signal of the outputted test audio.

Here, the channel difference compensator may be additionally configured to amplify the audio signal of a channel of the multi-channel audio signal provided to the speaker having a lower volume output among the first speaker and the second speaker, or to attenuate the audio signal of a channel of the multi-channel audio signal provided to the speaker having a higher volume output among the first speaker and the second speaker, so as to equalize the outputs of the first speaker and the second speaker, based on the determined volume output difference between the first speaker and the second speaker.

In order to solve the above-mentioned problems, an audio system according to an embodiment of the present disclosure may include an audio processing device and an audio recording device. The audio recording device may record an audio signal outputted from a plurality of speakers and feed back the audio signal to an audio processing device, and the audio processing device may determine an output delay time of the speakers based on the fed back audio signal.

The audio recording device of the audio system according to this embodiment of the present disclosure may include an audio collector configured to collect audio outputted by the plurality of speakers provided with an audio signal from the audio processing device, and an audio transmitter configured to transmit the collected audio signal to the audio processing device. The audio collector may comprise a microphone.

The audio processing device of the audio system according to this embodiment of the present disclosure may include a mixer configured to adjust the number of channels of an inputted audio signal based on the number of speakers connected to the audio system. a transmitter configured to transmit an audio signal of which the number of channels has been adjusted, or a test audio signal for speaker setup, to at least one speaker among the plurality of speakers, a feedback receiver configured to receive, from the audio recording device, a signal of the collected audio, a channel difference determiner configured to determine the output time difference between the plurality of speakers, based on the collected audio signal, and a channel difference compensator configured to add an output delay signal to the audio signal of at least one channel of a multi-channel audio signal provided to the plurality of speakers so as to synchronize the outputs of the plurality of speakers, based on the determined output time difference.

A method for providing a multi-channel audio signal to a plurality of speakers performed by the audio device according to this embodiment of the present disclosure may include a transmitting step for transmitting a test audio signal, generated for speaker setup, to at least one speaker among the plurality of speakers, a feedback receiving step for receiving, from a microphone that has collected audio outputted by at least one speaker among the plurality of speakers, a signal of the outputted audio, a channel difference determining step for determining an output time difference between the plurality of speakers, based on the signal of the outputted audio, and a channel difference compensating step for setting an output delay buffer in at least one channel path among multi-channel paths of an audio signal provided to the plurality of speakers so as to synchronize the outputs of the plurality of speakers, based on the determined output time difference.

In the method for providing a multi-channel audio signal according to this embodiment of the present disclosure, the transmitting step may be a step for transmitting the same test audio signal to a first speaker and a second speaker, among the plurality of speakers.

Here. the test audio signal may be a signal having a specific frequency pattern, and the feedback receiving step may be a step for receiving, from a microphone that has collected the test audio outputted by the first speaker and the second speaker, a signal of the outputted test audio.

Further, the channel difference determining step may be a step for determining an output time difference between the first speaker and the second speaker, by measuring portions in the signal of the outputted test audio where the signal strength of the specific frequency reaches local maximum values.

In a method for providing a multi-channel audio signal according to another embodiment of the present disclosure, a transmitting step may be a step for transmitting a first test audio signal to a first speaker among a plurality of speakers, and a second test audio signal to a second speaker among the plurality of speakers.

Here, the first test audio signal is a signal having a first volume and the second test audio signal is a signal having a second volume, and the first volume and the second volume are different in level from each other, and a feedback receiving step may be a step for receiving, from a microphone that has collected the test audio outputted by the first speaker and the second speaker, a signal of the outputted test audio.

In addition, a channel difference determining step may be a step for determining an output time difference between the first speaker and the second speaker, by measuring a portion in the signal of the outputted test audio where the gain value changes.

In a method for providing a multi-channel audio signal according to another embodiment of the present disclosure, a transmitting step may be a step for transmitting a test audio signal to a first speaker among a plurality of speakers, and a feedback receiving step may be a step for receiving, from a microphone that has collected the test audio outputted by the first speaker, a signal of the outputted test audio.

Here, the method for providing a multi-channel audio signal may include, after the feedback receiving step and before the channel difference determining step, a retransmitting step for transmitting. to the first speaker, a signal of the test audio received from the microphone, and repeating the feedback receiving step and the retransmitting step a predetermined number of times.

In addition. the channel difference determining step may be a step for measuring. through the repeating of the feedback receiving step and the retransmitting step, a round-trip latency of the first speaker. and determining an output time difference between the first speaker and the second speaker based on the measured round-trip latency of the first speaker and previously stored data on an output delay time of the second speaker.

In a method for providing multi-channel audio according to embodiments of the present disclosure, a channel difference compensating step may be a step for setting an output delay buffer in a channel path, in a multi-channel audio signal, provided to the speaker having a lower output delay among a first speaker and a second speaker so as to synchronize the outputs of the first speaker and the second speaker, based on a determined output time difference between the first speaker and the second speaker.

In a method for providing multi-channel audio according to yet another embodiment of the present disclosure, a transmitting step may be a step for transmitting the same test audio signal to a first speaker and a second speaker among a plurality of speakers, at an interval of a first time period.

Here, a feedback receiving step may be a step for receiving, from a microphone that has collected the test audio outputted by the first speaker and the second speaker, a signal of the outputted test audio.

In addition, a channel difference determining step may additionally include determining a volume output difference between the first speaker and the second speaker, based on the difference between the average volume of an initial audio signal and the average volume of a later audio signal, existing after the first time period has elapsed since the starting point of the initial audio signal, in the signal of the outputted test audio.

Embodiments of the present disclosure may provide an audio device, an audio system, and a method that enable synchronization between the outputs of a plurality of speakers to be maintained, while at the same time enabling a multi-channel audio system to be built at a low cost, unlike the case in conventional stereophonic sound systems.

Embodiments of the present disclosure may provide an audio device, an audio system, and a method capable of automatically adjusting an audio signal for each individual channel in accordance with the characteristics of each speaker, by adopting a configuration in which audio outputted from the speakers is fed back to the audio device that processes the audio signals.

Accordingly. the embodiments of the present disclosure may provide an audio device, an audio system, and a method capable of enabling easy implementation of a stereophonic sound system using wireless speakers which a user already owns, thus avoiding the additional costs involved in providing an additional speaker.

In addition, the embodiments of the present disclosure may provide an audio device, an audio system, and a method capable of synchronizing the audio outputs of each speaker even when wired and wireless speakers are used together, by enabling an output delay time for each individual channel to be determined by feeding back an outputted audio signal to an audio processing device.

Accordingly, the embodiments of the present disclosure may provide an audio device and an audio system and a method in which not only wired speakers but also wireless speakers can be used, thereby enabling implementation of a stereophonic sound system requiring minimal arrangement of cables, and which is relatively free from limitations regarding installation distance.

In addition, the embodiments of the present disclosure may provide an audio device, an audio system, and a method capable of enabling easy implementation of a stereophonic sound system without requiring the assistance of an expert, by enabling determination of an output delay time and compensation of the output delay time for each channel to be performed automatically by using feedback of audio signals outputted by the speakers.

Furthermore, an audio device, an audio system, and a method according to the embodiments of the present disclosure may generate a compensation signal as required in accordance with the characteristics of each speaker, due to differences in performance and specification, and the like for each speaker, by using feedback of audio signals outputted by the speakers. Accordingly, a uniform level of output between the speakers may be ensured.

BRIEF DESCRIPTION OF THE DRAWINGS

The foregoing and other objects, features, and advantages of the disclosure, as well as the following detailed description of the embodiments, will be better understood when read in conjunction with the accompanying drawings. For the purpose of illustrating the disclosure, there is shown in the drawings an exemplary embodiment that is presently preferred, it being understood, however, that the disclosure is not intended to be limited to the details shown because various modifications and structural changes may be made therein without departing from the spirit of the disclosure and within the scope and range of equivalents of the claims. The use of the same reference numerals or symbols in different drawings indicates similar or identical items.

DETAILED DESCRIPTION

Figure 1:
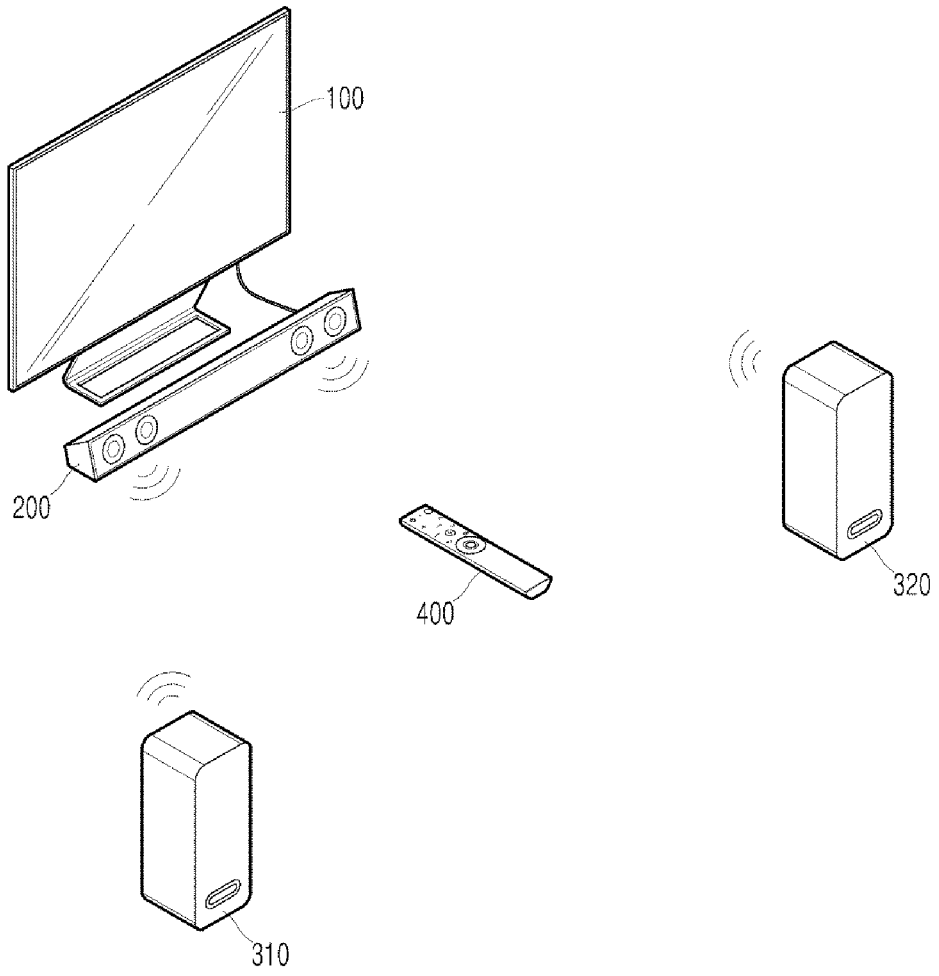
FIG. 1 is a schematic view of an audio system for providing a multi-channel audio signal to a plurality of speakers according to an embodiment of the present disclosure.

Advantages and features of the present disclosure and methods for achieving them will become apparent from the descriptions of aspects herein below with reference to the accompanying drawings. However, the present disclosure is not limited to the aspects disclosed herein but may be implemented in various different forms. The aspects are provided to make the description of the present disclosure thorough and to fully convey the scope of the present disclosure to those skilled in the art. It is to be noted that the scope of the present disclosure is defined only by the claims.

The shapes, sizes, ratios, angles, the number of elements given in the drawings are merely exemplary, and thus, the present disclosure is not limited to the illustrated details. Like reference numerals designate like elements throughout the specification.

In relation to describing the present disclosure, when the detailed description of the relevant known technology is determined to unnecessarily obscure the gist of the present disclosure, the detailed description may be omitted The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components. but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

FIG. 1 is a schematic view of an audio system for providing a multi-channel audio signal to a plurality of speakers according to an embodiment of the present disclosure.

The audio system in FIG. I includes a TV 100, a wired speaker 200, wireless speakers 310 and 320, and a remote control 400. The TV 100 is a device for reproducing an image and audio, but is shown here as an example of an audio device. In the embodiments of the present disclosure, any device capable of reproducing audio may be a substitute for the TV 100.

The audio device 100 reproduces an image through a display in an image portion, and in an audio portion, causes audio to be outputted by processing an inputted audio signal and transmitting the audio signal to the wired speaker 200 and the wireless speakers 310 and 320.

The wired speaker 200 is directly connected by wire to the audio device 100 to receive an audio signal, and may output an audio signal of a left front channel and an audio signal of a right front channel among audio signals processed by the audio device 100.

The wireless speakers 310 and 320 include a left rear wireless speaker 310 and a right rear wireless speaker 320. and may receive, and then output. an audio signal of a left front channel and an audio signal of a right front channel among the audio signals processed by the audio device 100. connected, for example, via Bluetooth™.

Here. the connection between the audio device 100 and the wireless speakers 310 and 320 may be made via various methods, such as Bluetooth™, RFID, Ultra Wideband (UWB), infrared communication, Zigbee, Digital Living Network Alliance (DLNA) Wi-Fi Direct, Wireless Broadband (Wibro), and Long Term Evolution/Long Term Evolution Advanced (LTE/LTE-A).

The remote control 400 is a device capable of controlling operation of the audio device 100 by sending a signal to the audio device 100. Here, the remote control 400 includes a microphone, and may perform a function of collecting audio outputted from the wired and wireless speakers.

When an audio signal is transmitted from the audio device 100 to the wired speaker 200 and the wireless speakers 310 and 320, and the audio is outputted by the wired speaker 200 and the wireless speakers 310 and 320, the remote control 400 may receive the outputted audio via the microphone, and feed back the outputted audio to the audio device 100.

The remote control 400 may be placed in the middle of a listening space formed by the wired speaker 200 and the wireless speakers 310 and 320, so as to be able to listen to the sound outputted from each speaker in a balanced manner.

However, if a user's main listening position is not in the center of the listening space, the remote control 400 may be placed at the user's main listening position, so that the audio outputted by the speakers can be collected at the user's main listening position.

Figure 2:
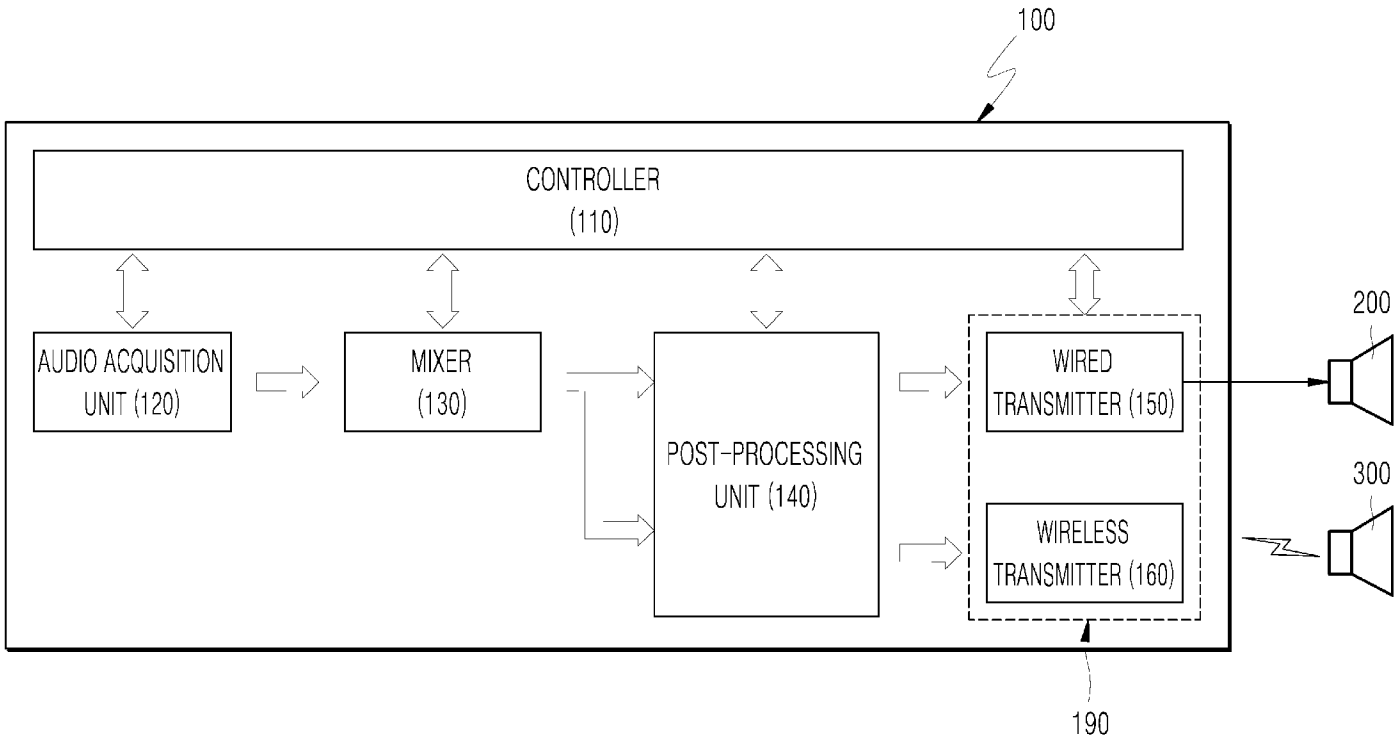
FIG. 2 is an internal block diagram of an audio device for providing a multi-channel audio signal to a plurality of speakers according to an embodiment of the present disclosure.

FIG. 2 is an internal block diagram of an audio device for providing a multi-channel audio signal to a plurality of speakers according to an embodiment of the present disclosure.

The audio device 100 may include a controller 100, an audio acquisition unit 120, a mixer 130, a post-processor 140, and a transmitter 190. The transmitter 190 may include a wired transmitter 150 for transmitting an audio signal to the wired speaker 200, and a wireless transmitter 160 for transmitting an audio signal to wireless speakers 300.

In FIG. 1, one wired speaker 200 and two rear wireless speakers 310 and 320 are illustrated. However. for the sake of convenience of explanation. embodiments of the present disclosure will be described assuming that there is one wired speaker 200 and only one wireless speaker 300.

First, operations of the components in the audio device 100 are performed in communication with the controller 110.

The audio acquisition unit 120 receives an external audio signal in real time, or acquires an audio signal from a storage space in the audio device 100. An audio signal obtained from the audio acquisition unit 120 is then transmitted to the mixer 130.

The mixer 130 then adjusts the number of channels of the inputted audio signal, based on the number of speakers connected to the audio device 100. The number of speakers connected to the audio device 100 may be manually inputted in advance into the audio device 100, or may be automatically acquired by the audio device 100 through communication between the audio device 100 and the speakers.

When the number of speakers connected to the audio device 100 is equal to the number of channels of the inputted audio signal, the mixer may bypass the inputted audio signal, and when the number of speakers connected to the audio device 100 is different from the number of channels of the inputted audio signal, the mixer may upmix or downmix the inputted audio signal, so that the number of channels of the audio signal is equal to the number of speakers connected to the audio device 100.

For example, supposing that the number of channels of the audio signal inputted from the audio device 100 is two, and the number of speakers connected to the audio device 100 is six (as speakers for use in a 5.1 channel system), the mixer 130 may upmix the two channel audio signal to a 5.1 channel audio signal.

As another example, if the audio signal inputted into the audio device 100 is a 5.1 channel signal, and the number of speakers connected to the audio device 100 is two, the mixer 130 may downmix the 5.1 channel audio signal to a two channel audio signal.

As still another example, if the audio signal inputted into the audio device 100 is a 5.1 channel signal, and the number of speakers connected to the audio device 100 is six (as speakers for use in a 5.1 channel system), the mixer 130 may bypass the 5.1 channel audio signal without adjustment.

The audio signal adjusted or bypassed by the mixer 130 is then transmitted to the post-processor 140. The post-processor 140 performs processing operations as required for the audio signal of each channel, the details of which will be described below.

Among the audio signals that have undergone processing, such as application of a sound field effect, in the post-processor 140, an audio signal of the channel to be output from the wired speaker 200 is transmitted to the wired transmitter 150, and an audio signal of the channel to be outputted from the wireless speaker 300 is transmitted to the wireless transmitter 160. In some cases, the audio signal may be transmitted only to some of the speakers, not to all of the plurality of speakers.

The wired transmitter 150 then transmits the audio signal of the corresponding channel to the wired speaker 200 via a wired connection, and the wireless transmitter 160 transmits the audio signal of the corresponding channel to the wireless speaker 300 via a Bluetooth™ connection.

In addition to the general case where the transmitter 190 transmits an audio signal to be reproduced to the speakers, there is also a case in which, when the audio device 100 enters a speaker setting mode in order to set up the synchronization of the speakers, the transmitter 190 may transmit a test audio signal to the speakers.

In such a case, the test audio signal may be a signal previously stored in the audio device 100, or an externally received signal.

Here, in the absence of specific circumstances, the signal to be transmitted to the wired speaker 200, connected by wire, is immediately transmitted and outputted from the wired speaker 200 without any delay. However, a wireless connection may be influenced by various environmental factors, and thus a time delay may occur in the processing from signal transmission to audio output.

In the outputting of audio by a speaker, which is a device for outputting audio, an error in which the output of an audio signal is delayed due to the audio system itself may be referred to as a system delay error.

Examples of such a system delay error may include a delay occurring in an audio signal transmission process due to a network environment, and a delay occurring in a signal processing process of an audio outputting device.

Figure 3:
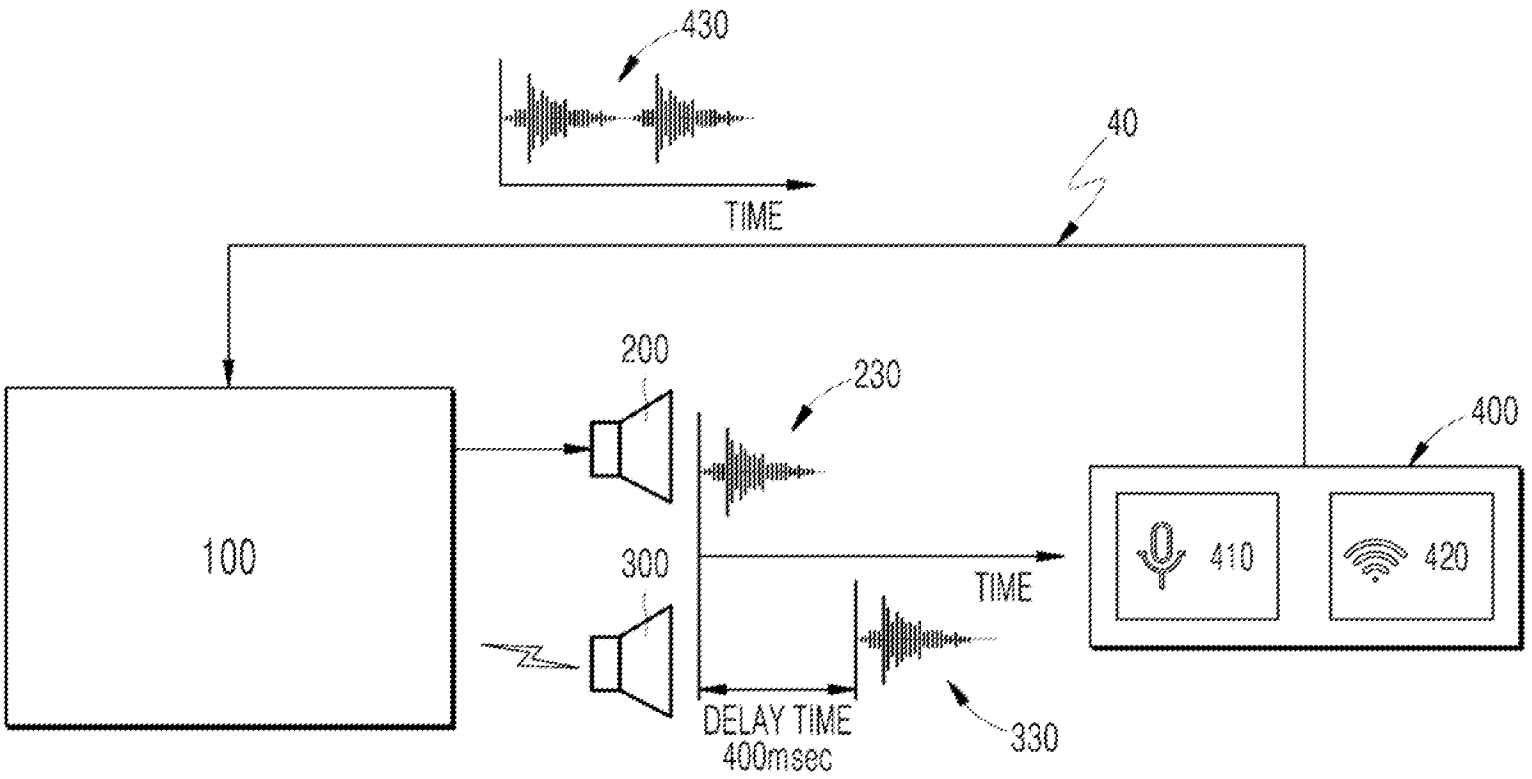
FIG. 3 illustrates a process of feeding back an audio signal outputted from an audio device according to an embodiment of the present disclosure.

FIG. 3 illustrates a process of feeding back an audio signal outputted from an audio device according to an embodiment of the present disclosure.

As illustrated in FIG. 3, the wireless speaker 300 has a time delay of 400 msec in the processing from signal transmission to audio output, as compared with the wired speaker 200.

Accordingly, although the audio signals of the wired speaker 200 and the wireless speaker 300 should be simultaneously outputted, the audio signal of the wireless speaker 300 is outputted, as a second audio output 330, 400 msec after the audio signal of the wired speaker 200, as a first audio output 230, is outputted. Thus, the multi-channel audio signal, of which the audio signal for each channel should be simultaneously outputted, is outputted with a time difference between the channels.

As illustrated in FIG. 3, the audio outputted by the speakers is collected by an audio recording device 400, which includes a microphone 410 and a transmitter 420. The audio collected by the audio recording device 400 becomes a combined audio output 430, in which the first audio output 230 and the second audio output 330 are combined.

The combined audio output 430, collected by the audio recording device 400, may be provided to the audio device 100 via a feedback loop 40. Here, the feedback loop 40 may be wired or wireless.

In addition, although the audio recording device 400 is illustrated as being separate from the audio device 100 in FIG. 3, this is only for the purpose of functionally separating and displaying, the audio device 100 and the audio recording device 400. The audio recording device 400 may be a remote control including a microphone, but may also be a microphone and a transmitting module installed in the audio device 100 itself.

For example, the audio recording device 400 may be a microphone device installed in a TV. which is the audio device 100.

As another example, as in FIG. 1, the audio recording device 400 may be a remote control 400 including a microphone. When the remote control 400, capable of being moved externally, is the audio recording device, the remote control 400 may be placed at an actual position where the user listens to the sound of the speakers, so as to collect more accurate outputted audio information from the perspective of the user.

Figure 4:
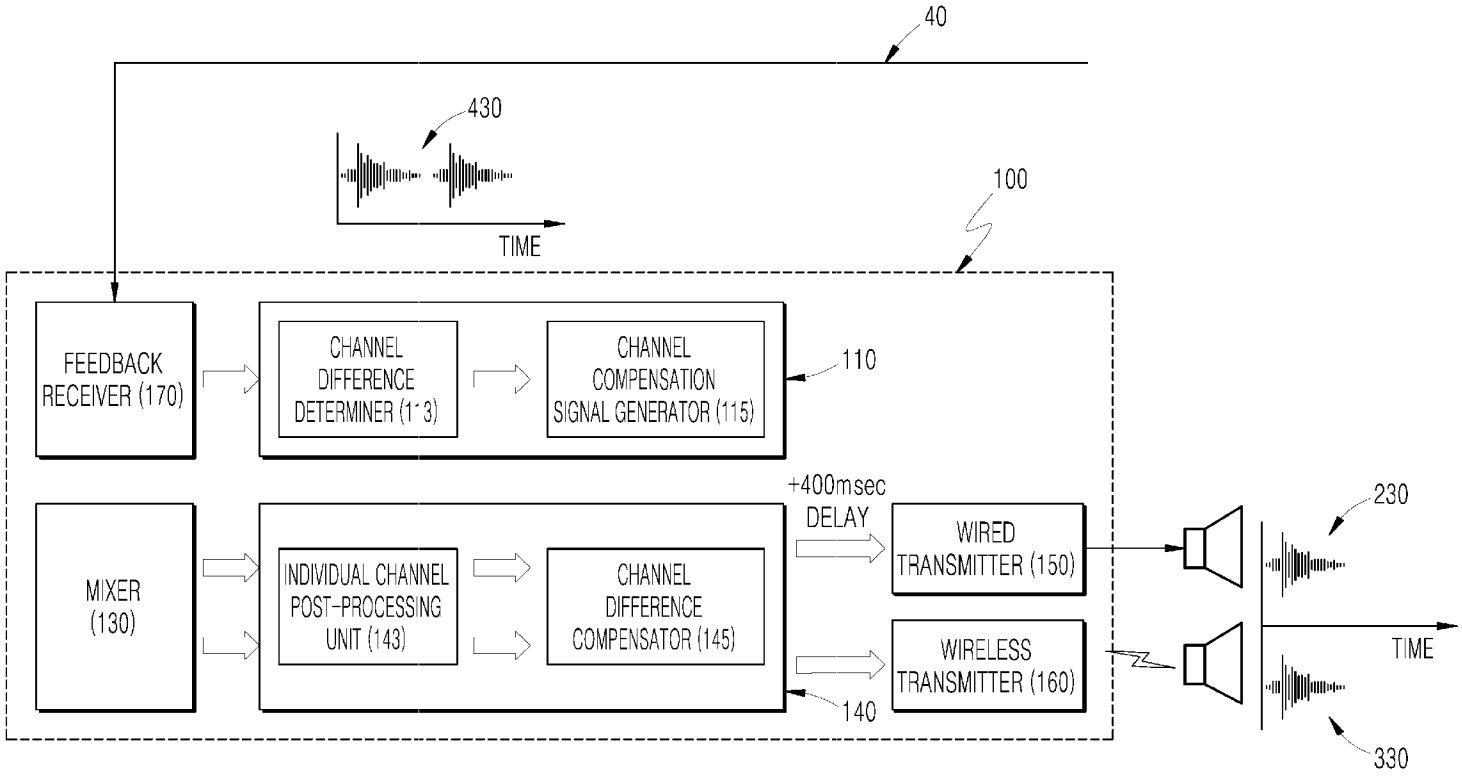
FIG. 4 illustrates a process in which a difference between individual channels is compensated, based on an audio signal fed back to an audio device according to an embodiment of the present disclosure.

FIG. 4 illustrates a process in which a difference between individual channels is compensated, based on an audio signal fed back to an audio device according to an embodiment of the present disclosure.

The signal 430 of the audio outputted from the plurality of speakers, which is fed back to the audio device 100, is received by a feedback receiver 170.

The feedback receiver 170 transmits the signal 430 of the outputted audio to the controller 110, which includes a channel difference determiner 113 and a channel compensation signal generator 115. The channel difference determiner 113 of the controller 110 determines the extent of the output time difference between the plurality of speakers, based on the signal 430 of the outputted audio which is fed back to the audio device 100.

Determining the extent of the output time difference between the plurality of speakers may be performed in various ways, some examples of which will be described below.

Figure 5:
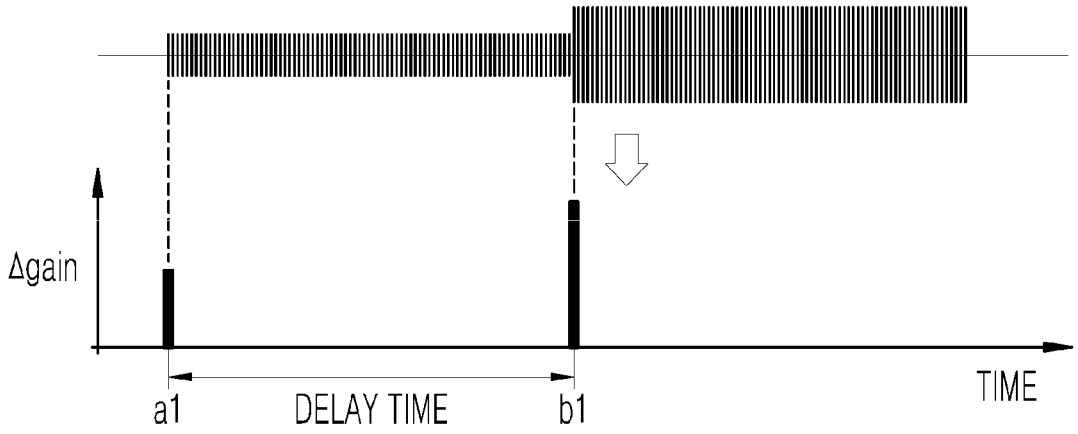
FIG. 5 illustrates a method for determining a delay time by analyzing a test audio signal outputted from speakers according to an embodiment of the present disclosure.

FIG. 5 illustrates a method for determining a delay time by analyzing a test audio signal outputted from speakers according to an embodiment of the present disclosure.

As illustrated in FIG. 5, the transmitter 190 transmits a first test audio signal to a first speaker (for example. the wired speaker 200) and a second test signal to a second speaker (for example, the wireless speaker 300), among the plurality of speakers.

Here, the first test audio signal is a signal having a first volume and the second test audio signal is a signal having a second volume, and the first volume is lower than the second volume. The first test audio signal and the second test audio signal may be audio signals of the same type, with only the volumes thereof being different.

In another embodiment, a speaker setting mode may be configured such that the transmitter 190 of the audio device 100 transmits the same test audio signal to the plurality of speakers, and the first speaker (for example, the wired speaker 200) and the second speaker (for example. the wireless speaker 300) reproduce the test audio signal at different volumes.

In such a case, when the first speaker outputs the test audio signal at a volume of, for example 5, and the second speaker outputs the same test audio signal at a volume of, for example, 20, the microphone may collect audio composed of the above audio having two different volumes.

Here, the volume of the speakers may be adjusted by a volume control signal transmitted to the speakers from the audio device 100 or the remote control 400 in the speaker setting mode.

The waveform in the upper part of FIG. 5 represents audio outputted from speakers that have received the first test audio signal and the second test audio signal, or audio outputted from speakers that have received the same test audio signal but have been set to different volumes, which have been collected by the microphone.

The waveform in FIG. 5 shows that the first test audio signal having the lower first volume is first outputted, through the wired speaker 200, at time a1. The second test audio signal having the higher second volume is then outputted, through the wireless speaker 300, at time b1, later than time a1. The discrepancy in output times between the speakers is due to a delay in transmission to the wireless speaker and a processing delay in the wireless speaker.

According to the embodiment in which the same test audio signal is transmitted to the speakers that have been set to different volumes, the waveform of FIG. 5 shows that the test audio signal is first outputted, at time a1, from the first speaker which has been set to a lower volume. The same test audio signal is then outputted at time b1, later than time a1, from the second speaker, which has been set to a higher volume. Such a delay may be due to a delay in transmission to the wireless speaker and a processing delay in the wireless speaker.

The feedback receiver 170 receives a waveform such as that shown in FIG. 5, as the signal of the audio outputted from the speakers. and transmits the audio signal to the channel difference determiner 113.

The channel difference determiner 113 may measure the amount of time between a1 and b1, which represents a portion where the gain value changes in a waveform such as that in FIG. 5, and may thereby determine that the output time difference between the wired speaker 200 and the wireless speaker 300 is a1-b1, and that the output delay time of the wireless speaker 300 relative to the wired speaker 200 is a1-b1.

Figure 6:
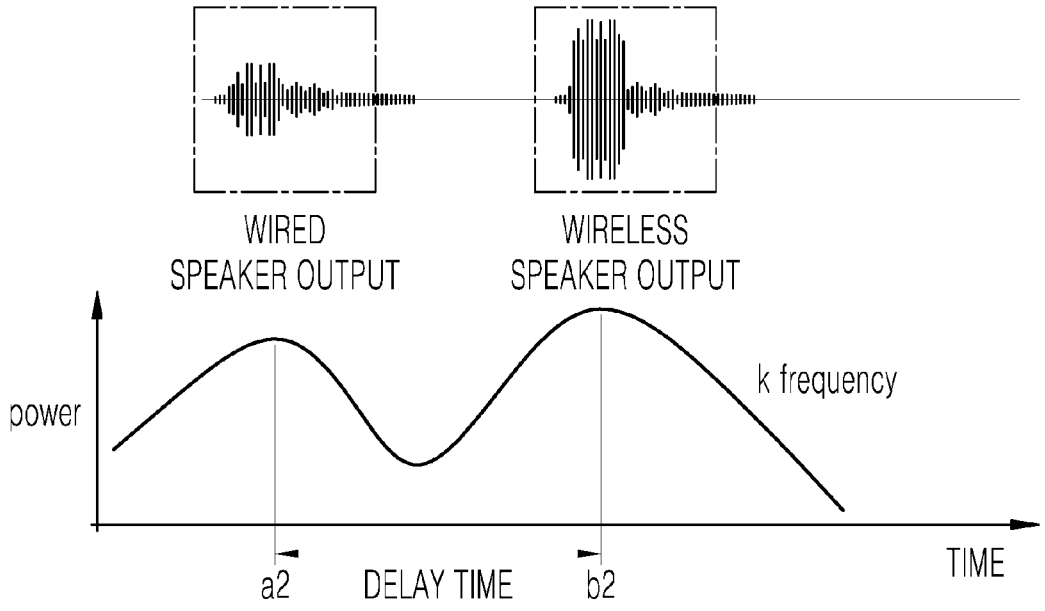
FIG. 6 illustrates a method for determining a delay time by analyzing a test audio signal outputted from speakers according to another embodiment of the present disclosure.

FIG. 6 illustrates a method for determining a delay time by analyzing a test audio signal outputted from speakers according to another embodiment of the present disclosure.

In FIG. 6, the transmitter 190 may simultaneously transmit the same test audio signal to a first speaker (for example, the wired speaker 200) and a second speaker (for example, wireless speaker 300), among the plurality of speakers.

Here, the test audio signal is a signal having a specific frequency pattern.

The waveform in the upper part of FIG. 6 represents audio outputted from the speakers, which has been collected by a microphone. The waveform shows that, at time a2, the audio signal outputted from the wired speaker 200 reaches a local maximum value, and that the audio signal outputted from the wireless speaker 300 reaches a local maximum value at time b2, later than a2, due to a delay in transmission to the wireless speaker 300 and a processing delay in the wireless speaker 300.

The feedback receiver 170 receives a waveform such as that shown in FIG. 6, as the signal of the audio outputted from the speakers, and transmits the audio signal to the channel difference determiner 113.

The channel difference determiner 113 may then measure a2 and b2, which represent the times at which the specific frequency reaches a local maximum value, by performing Fast Fourier Transform (FFT) on the waveform such as that in FIG. 6, and thereby determine the relative delay time of the wireless speaker 300.

Here, the method of determining the delay time through the FFT comprises sampling a test audio signal having a specific frequency pattern, determining the number samples between samples having local maximum values, and multiplying the number of samples by the time per sample to thereby calculate the delay time.

For example, when a test audio signal is a 16 kHz, 2-byte mono signal, and is sampled once for every 256 pieces of 2-byte data transmitted, there is a time difference of 16 msec between each sample. More specifically, in an audio signal in which 16,000 pieces of 2-byte data are transmitted in 1 second, when one sample is made for every 256 pieces of 2-byte data transmitted, a time x during which 256 pieces of 2-byte data are transmitted may be calculated by the expression 1,000 msec (1 second):16,000=x msec:256.

In this case, if the local maximum values are reached in the 20th sample and the 30th sample, the number of samples between the two maximum values is 10, and the time difference between each sample is 16 msec. Accordingly, the delay time between the wired speaker 200 and the wireless speaker 300 is determined to be 160 msec.

In other words, when a waveform such as that in FIG. 6 is fed back to the audio device 100 via the microphone 410, the channel difference determiner 113 may determine that the output time difference between the wired speaker 200 and the wireless speaker 300 is a2-b2, and that the output delay time of the wireless speaker 300, relative to the wired speaker 200, is a2-b2.

Further, although not illustrated in the drawings, the delay time of a speaker connected to the TV may be determined using a round-trip latency, which is mainly used in determining output delay relative to input in a smartphone.

The round-trip latency measurement in the TV speaker is made by first repeating an operation in which a test signal is first outputted from the speaker of the TV, a microphone in communication with the TV then receives input of the outputted test signal, the speaker of the TV then again outputs the inputted test signal, the microphone then again receives input of the outputted test signal, and the speaker of the TV then again outputs the inputted test signal. The round-trip latency is then determined by measuring a delay time between input and output that occurs while the above operation is repeated.

Similar to the manner described above, in the audio device 100 according to an embodiment of the present disclosure, an operation in which the test audio signal is first transmitted to the wireless speaker 300 and outputted via the wireless speaker 300, the outputted audio is then received via the microphone 410 and transmitted to the audio device 100, and the received signal of the outputted audio is then again transmitted by the audio device 100 to the wireless speaker 300 and outputted from the wireless speaker 300. is repeated a predetermined number of times.

By repeating the above operation, the round-trip latency of the wireless speaker 300 may be determined by measuring the delay occurring between input (received by the microphone 410) and output (from the wireless speaker 300).

Here, the channel difference determiner 113 may determine the output time difference between the wired speaker 200 and the wireless speaker 300, based on the round-trip latency of the wireless speaker 300 and previously stored data on the output delay time of the wired speaker 200.

The data on the output delay time of the wired speaker 200 may have been previously measured and stored in a data storage of the audio device 100.

The audio device 100 may learn the delay time characteristics for the respective speaker models using the various methods described above, and may store the delay time characteristics in an internal storage space of the audio device 100 or a cloud-based storage space to thereby build a database of delay times for various speaker models.

When such a database is built, the audio device 100 may determine the delay time simply by checking the information on the corresponding speaker model in the database, without performing the delay time measurements described above. In order to compensate for the delay time, the audio device 100 may then set an appropriate delay time buffer in the output channel path.

Although only a case in which two speakers are connected was described above, the same method may naturally be applied to a plurality of speakers.

If a new speaker is connected to the audio device 100, and the output time difference between the two speakers is already known through the methods described above, a delay time of the new speaker may be measured, and thereafter a delay time deviation between the new speaker and the previous speakers may be obtained, and a delay time value to be set for each speaker may be selected.

If the new speaker is the same model as a speaker for which the delay was previously measured. data from the speaker of the same model may be used, without making any further delay time measurements.

Returning to FIG. 4, channel difference determiner 113 may determine the output time difference between the speakers using the various methods described above, and transmit information regarding the output time difference to the channel compensation signal generator 115. The channel compensation signal generator 115 may generate a compensation signal to compensate for the output time difference between the speakers, and transmit the compensation signal to a channel difference compensator 145 of the post-processor 140.

The post-processor 140 receives the multi-channel audio signal from the mixer 130, and performs, via an individual channel post-processor 143, post-processing as required for each channel, such as adding a sound field effect. The post-processor 140 then transmits an audio signal for each channel to the channel difference compensator 145.

The channel difference compensator 145 is configured to add an output delay signal to the audio signal of individual channels so as to compensate for a delay time between the channels, according to the compensation signal received from the controller 110.

For example, as shown in FIG. 3, if the wireless speaker 300 has an output delay time of 400 msec as compared with the wired speaker 200, the channel difference compensator 145 adds an output delay signal of 400 msec to the audio signal of the channel outputted to the wired speaker 200.

Accordingly, the audio signal of the channel outputted to the wired speaker 200 via the wired transmitter 150 is delayed by 400 msec, and is synchronized with the audio signal of the channel outputted via the wireless speaker 300 having the 400 msec delay.

Figure 7:
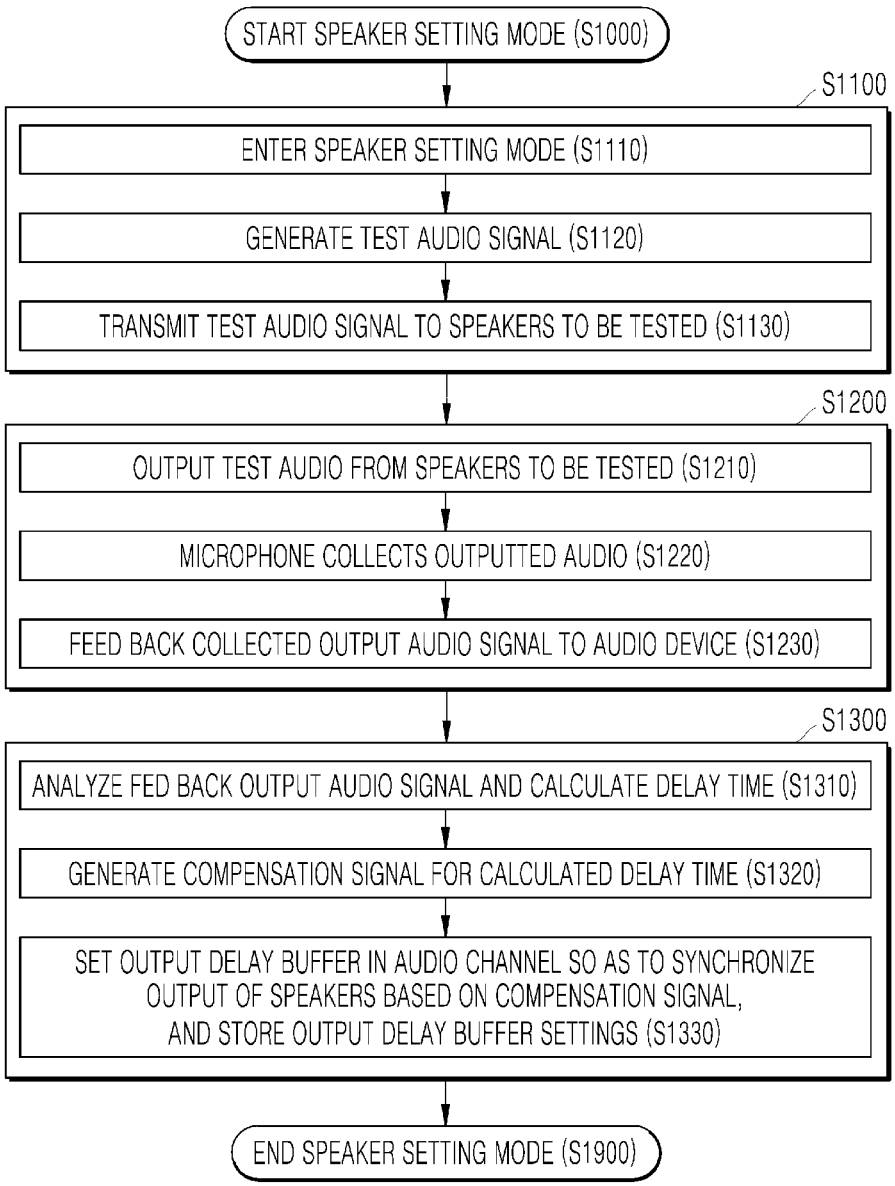
FIG. 7 is a flowchart illustrating a method for providing a multi-channel audio signal to a plurality of speakers according to an embodiment of the present disclosure.

FIG. 7 is a flowchart illustrating a method for providing a multi-channel audio signal to a plurality of speakers according to an embodiment of the present disclosure.

Once the audio device 100 is connected to the plurality of speakers 200 and 300, and before the multi-channel audio source is reproduced, the audio device 100 may first enter a speaker setting mode, in order to synchronize the output times and equalize the output levels of the speakers (S1110).

The speaker setting mode may be started in response to an instruction of a user. or may be automatically started when it is detected that a speaker has been newly connected to the audio device 100.

When the audio device 100 enters the speaker setting mode (S1110), a test audio signal is generated (S1120). The test audio signal may then be transmitted to the speakers to be tested (S1130). The above steps (S1100) may all be performed in the audio device 100.

Here, in accordance with the embodiments of the present disclosure as described above, the same test audio signal may be transmitted to each speaker, or test audio signals having different volumes may be transmitted to each speaker.

The speakers that have received the test audio signal may then output test audio (S1210), and the microphone 410 may collect the outputted audio (S1220). The collected output audio signal may be fed back to the audio device 100 by the transmitter 420 connected to the microphone 410 (S1230).

The audio device 100 may then receive the fed back output audio signal. By analyzing the fed back output audio signal in the manner described above, the audio device may calculate the output time difference between the speakers, and calculate a relative delay time (S1310).

A compensation signal may then be generated based on the calculated delay time (S1320). Thereafter, based on the compensation signal, an output delay buffer may be set in an audio channel path so as to synchronize the outputs of the speakers, and the output delay buffer settings may be stored in a data storage (S1330).

For example, referring to FIGS. 3 and 4, in order to synchronize the outputs between the wired speaker 200 and the wireless speaker 300, an output delay buffer of 400 msec may be set in the channel path of the audio signal to be outputted to the wired speaker 200.

Figure 8:
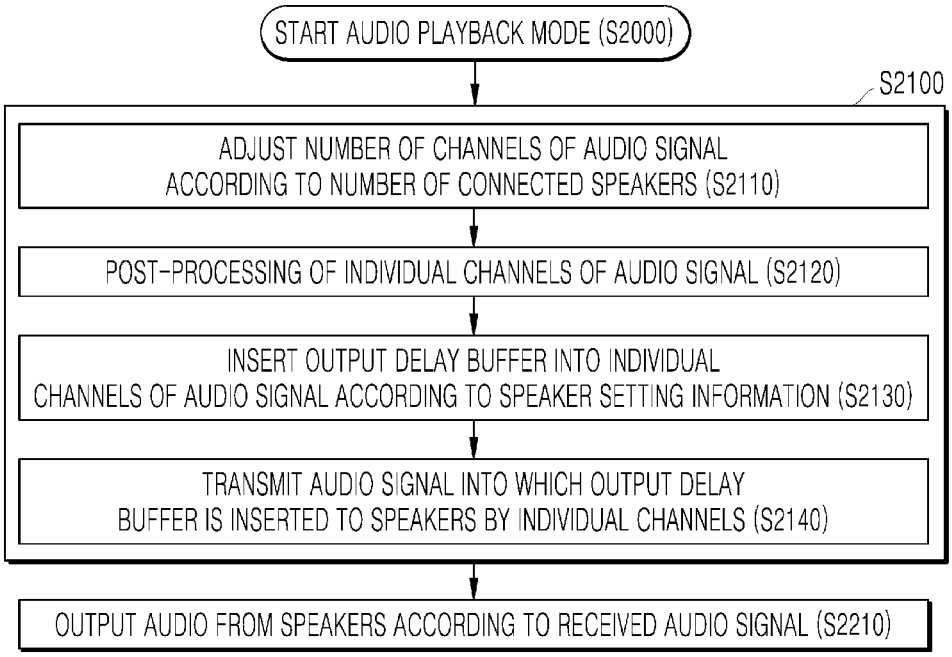
FIG. 8 is a flowchart illustrating a case where audio is reproduced after individual channel compensation is set according to the flowchart of FIG. 7.

FIG. 8 is a flowchart illustrating a case where a general audio playback mode is started, once the steps of the above-described speaker setting mode have all been performed (S1900).

When an audio signal to be reproduced is externally received and inputted into the audio device 100, the number of channels of the inputted audio signal is adjusted according to the number of speakers connected to the audio device 100 (S2110). Post-processing as required for each channel, such as adding a sound field effect, may be performed on the audio signals of which the number of channels have been adjusted (S2120). An output delay buffer may be inserted into the audio signal of individual channels, according to the output delay buffer settings stored in the speaker setting mode as described above (S2130).

Referring to FIGS. 3 and 4, in order to synchronize the outputs between the wired speaker 200 and the wireless speaker 300, an output delay buffer of 400 msec may be inserted into the audio signal of the channel to be outputted to the wired speaker 200.

The audio signal into which the output delay buffer is inserted is then transmitted to the speakers (S2140), and the speakers output audio according to the received audio signal (S2210).

Through the action of inserting the output delay buffer into individual channels as described above, the wired speaker 200 and the wireless speaker 300 is enabled to perform synchronized audio output.

Figure 9:
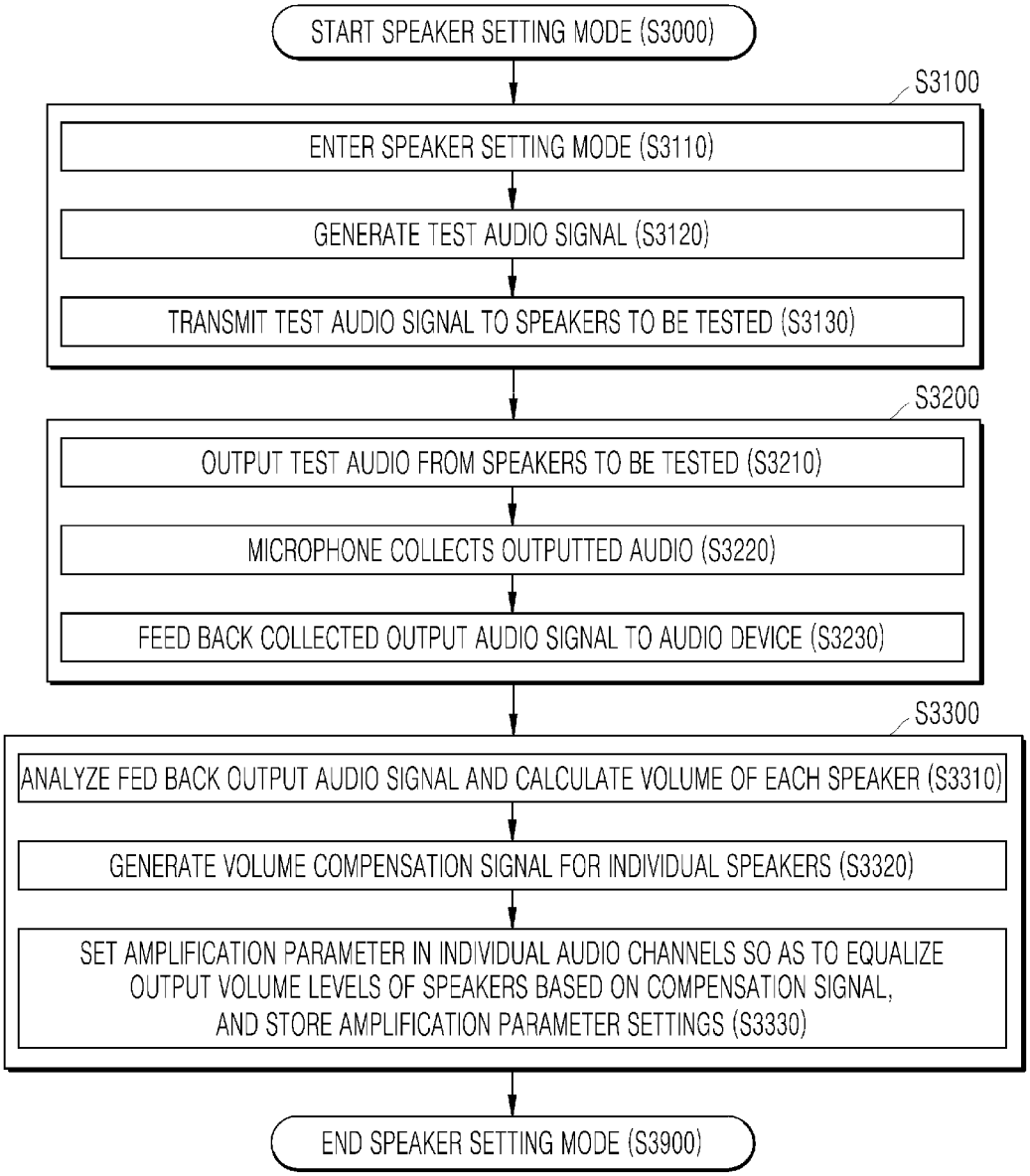
FIG. 9 is a flowchart illustrating a method for providing a multi-channel audio signal to a plurality of speakers according to another embodiment of the present disclosure.

FIG. 9 is a flowchart illustrating a method for providing a multi-channel audio signal to a plurality of speakers according to another embodiment of the present disclosure.

Once the audio device 100 is connected to the plurality of speakers 200 and 300, and before the multi-channel audio source is reproduced, the audio device 100 may first enter a speaker setting mode, in order to synchronize the output times and equalize the output levels of the speakers (S3110).

The speaker setting mode may be started in response to an instruction of a user, or may be automatically started when it is detected that a speaker has been newly connected to the audio device 100.

When the audio device 100 enters the speaker setting mode (S3110), a test audio signal is generated (S3120). The test audio signal may then be transmitted to the speakers to be tested (S3130). The steps (S3100) may all be performed in the audio device 100.

The step for transmitting the test audio signal may include first transmitting the test audio signal to the wired speaker 200 among the plurality of speakers, and then transmitting the same test audio signal to the wireless speaker 300 after a first time period has elapsed.

Here, the first time period may be preselected as a time difference such that the audio outputted from the speakers do not completely overlap each other, and the difference in volume outputted from each speaker can be observed.

The speakers that have received the test audio signal may then output test audio (S3210), and the microphone 410 may collect the outputted audio (S3220). The collected output audio signal may be fed back to the audio device 100 by the transmitter 420 connected to the microphone 410 (S3230).

By receiving and then analyzing the fed back output audio signal, the audio device 100 may calculate the output volume for each speaker, and calculate an output difference between the speakers (S3310).

Determining the output difference between individual channels or speakers may include determining a volume output difference between the wired speaker 200 and the wireless speaker 300, based on the difference between the average volume of an initial audio signal and the average volume of a later audio signal, existing after the first time period has elapsed since the starting point of the initial audio signal, in the signal of the outputted test audio.

Figure 11:
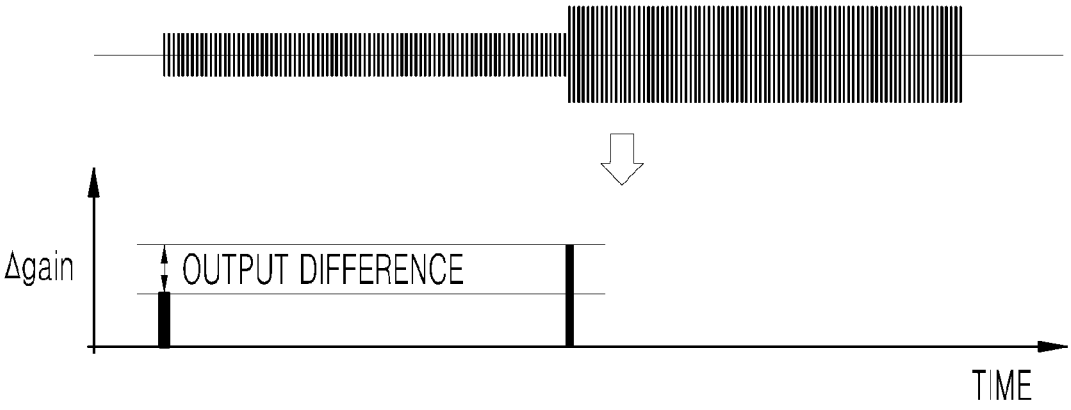
FIG. 11 illustrates a method for determining a volume difference between each speaker in the flowchart of FIG. 9.

Here, the initial audio signal and the later audio signal may refer to a previous signal and a subsequent signal, with respect to a point at which a difference occurs in the volume value, as shown in FIG. 11

A compensation signal is then generated based on the calculated volume output difference between the speakers (S3320). Thereafter. based on the compensation signal, an amplification parameter or an attenuation parameter may be set in individual channels so as to equalize the output volume levels of the speakers. and the amplification or attenuation parameter settings may be stored in the data storage (S3330).

For example, if as shown in FIG. 11 the output volume of the wired speaker 200 shown in the initial audio signal is lower than the output volume of the wireless speaker 300 shown in the later audio signal, even though a signal having the same volume has been transmitted thereto, an amplification parameter may be applied to the channel path of the audio signal to be outputted to the wired speaker 200 in order to equalize the output volumes of the speakers.

Figure 10:
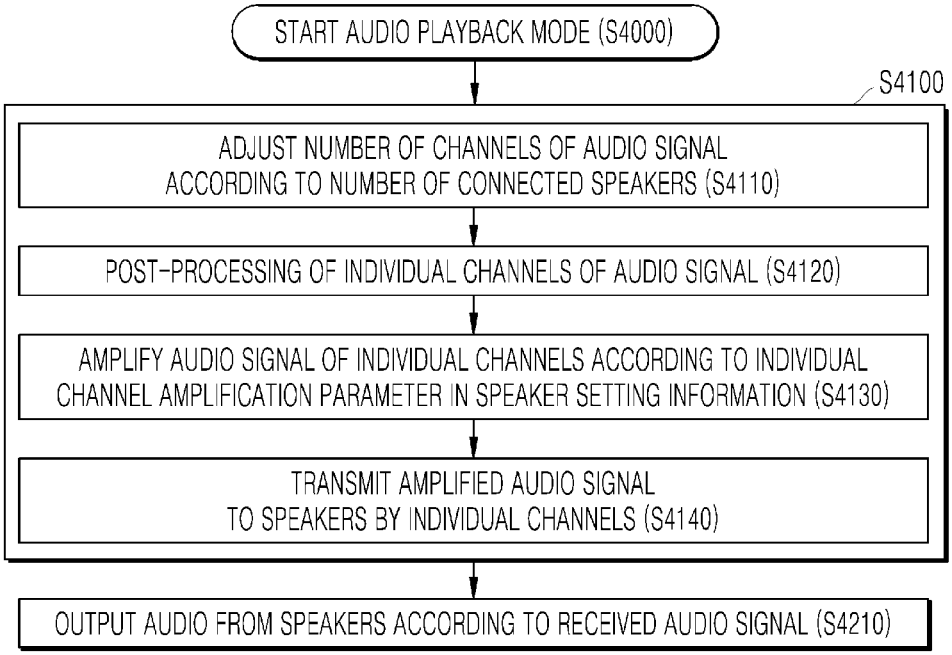
FIG. 10 is a flowchart illustrating a case where audio is reproduced once compensation for individual channels has been set according to the flowchart of FIG. 9.

FIG. 10 is a flowchart illustrating a case where a general audio playback mode is started, once the steps of the above-described speaker setting mode have all been performed (S3900).

When an audio signal to be reproduced is inputted into the audio device 100, the number of channels of the inputted audio signal is adjusted according to the number of speakers connected to the audio device 100 (S4110). Post-processing as required for each channel, such as adding a sound field effect, may be performed on the audio signals of which the number of channels have been adjusted (S4120). An amplification parameter or an attenuation parameter may be applied to the audio signal of individual channels, according to the amplification parameter or attenuation parameter settings stored in the speaker setting mode as described above (S4130).

That is, the audio signal of a channel of the multi-channel audio signal provided to the speaker having a lower volume output among the wired speaker 200 and the wireless speaker 300 may be amplified, or the audio signal of a channel of the multi-channel audio signal provided to the speaker having a higher volume output among the wired speaker 200 and the wireless speaker 300 may be attenuated, as to equalize the outputs of the wired speaker 200 and the wireless speaker 300. Amplified or attenuated audio signal can be transmitted to the speakers by individual channels (S4140), and audio signal can be played with equalized output at the speakers according to the received audio signal(S4210).

FIG. 11 illustrates a method for determining a volume difference between each speaker in the flowchart of FIG. 9.

As shown in FIG. 11, the volume of the audio outputted from the wired speaker 200 and the volume of the audio outputted from the wireless speaker 300 are different. even though the same test audio signal has been transmitted to the wired speaker 200 and the wireless speaker 300.

This difference is due to the fact the wireless speaker 300 has been set to output audio at a higher volume than the wired speaker 200, due to the characteristics of the wireless speaker 300.

Therefore, the output of the audio signal of the channel which is transmitted to the wired speaker 200 may be amplified, or the output of the audio signal of the channel which is transmitted to the wireless speaker may be attenuated, based on the difference between the output volumes recognized in the waveform in FIG. 11.

As a result, by transmitting an amplified audio signal to the speaker having a lower default output volume and transmitting an attenuated audio signal to the speaker having a higher default output volume, the output levels of the speakers can be automatically balanced.

Figure 12:
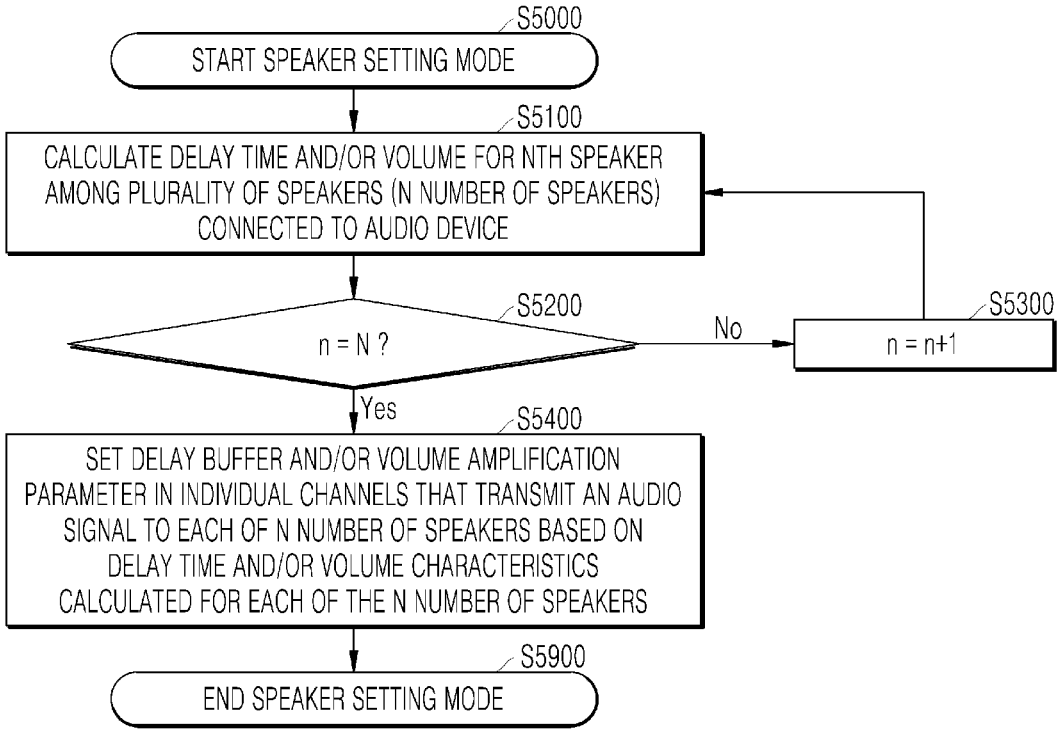
FIG. 12 is a flowchart illustrating a method for setting compensation for individual channels for a plurality of speakers according to still another embodiment of the present disclosure.

FIG. 12 is a flowchart illustrating a method for setting compensation for individual channels for a plurality of speakers according to still another embodiment of the present disclosure.

In FIG. 12, it is assumed that a plurality of speakers (for example, N number of speakers) are connected to the audio device 100.

The audio device 100 to which the plurality of speakers are connected may start the speaker setting mode upon externally receiving a speaker setting mode command, or may start the speaker setting mode automatically upon detecting a new speaker connection (S5000).

In the speaker setting mode. calculation of at least one of a delay time or a volume may first be performed for the first speaker. according to the methods described in FIG. 7 or FIG. 9 (S5100). The audio device 100 may temporarily store, in association with the first speaker, at least one of a delay time value or a volume characteristic value of the first speaker, derived by the performed calculation.

The audio device 100 determines whether the delay time and/or the volume have been calculated for all of the connected speakers (S5200).

This determination may be made using various methods. As an example. the determination may be made by comparing the data previously stored as above with information about the speakers connected to the audio device 100.

When it is determined in step S5200 that the delay time and/or the volume has not been calculated for all the speakers, the process may return to step S5100 and calculate the delay time and/or the volume for a next speaker (S5300).

When it is determined in step S5200 that the delay time and/or the volume has been calculated for all the speakers, a delay buffer and/or a volume amplification parameter may be set in individual channels that transmit an audio signal to each of N number of speakers, based on the delay time and/or the volume characteristics calculated for each of the N number of speakers (S5400).

Here, the delay buffer may be set such that the audio signal transmitted for each channel can be reproduced simultaneously by the speakers, and the volume amplification parameter may be set such that the audio signal transmitted for each channel can be reproduced at a uniform level by the speakers.

The present disclosure described as above is not limited by the aspects described herein and accompanying drawings. It should be apparent to those skilled in the art that various substitutions, changes and modifications which are not exemplified herein but are still within the spirit and scope of the present disclosure may be made. Therefore, the scope of the present disclosure is defined not by the detailed description, but by the claims and their equivalents, and all variations within the scope of the claims and their equivalents are to be construed as being included in the present disclosure.

What is claimed is:

1. An audio device for providing a multi-channel audio signal to a plurality of speakers, comprising:

at least one processor configured to:

adjust a number of channels of an input audio signal based on a number of speakers connected to the audio device;

transmit the audio signal of which the number of channels has been adjusted, or a test audio signal for a speaker setup, to at least one speaker among the plurality of speakers;

receive, from a microphone that has collected audio output by at least one speaker among the plurality of speakers, a signal of the output audio;

determine an output time difference between the plurality of speakers, based on the signal of the output audio; and add an output delay signal to the audio signal of at least one channel of the multi-channel audio signal provided to the plurality of speakers so as to synchronize outputs of the plurality of speakers, based on the determined output time difference, wherein when the number of speakers connected to the audio device is equal to the number of channels of the input audio signal, the at least one processor bypasses the input audio signal, and when the number of speakers connected to the audio device is different from the number of channels of the input audio signal, the at least one processor upmixes or downmixes the input audio signal, so that the number of channels of the audio signal is equal to the number of speakers connected to the audio device.

2. The audio device according to claim 1, wherein the test audio signal has a specific frequency pattern, and wherein in a speaker setting mode of the audio device, the at least one processor is further configured to:

transmit a same test audio signal to a first speaker and a second speaker, among the plurality of speakers;

receive, from the microphone that has collected test audio output by the first speaker and the second speaker, a signal of the output test audio; and determine an output time difference between the first speaker and the second speaker, by measuring portions in the signal of the output test audio where a signal strength of the specific frequency reaches local maximum values.

3. The audio device according to claim 2, wherein the at least one processor is further configured to:

add an output delay signal to an audio signal of a channel, of the multi-channel audio signal, provided to a speaker having a lower output delay among the first speaker and the second speaker, so as to synchronize outputs of the first speaker and the second speaker, based on the determined output time difference between the first speaker and the second speaker.

4. The audio device according to claim 1, wherein in a speaker setting mode of the audio device, the at least one processor is further configured to:

transmit a first test audio signal to a first speaker among the plurality of speakers, and a second test audio signal to a second speaker among the plurality of speakers;

receive, from the microphone that has collected test audio output by the first speaker and the second speaker, a signal of the output test audio; and determine an output time difference between the first speaker and the second speaker, by measuring a portion in the signal of the output test audio where a gain value changes, and wherein the first test audio signal has a first volume and the second test audio signal has a second volume, and the first volume and the second volume are different in level from each other.

5. The audio device according to claim 1, wherein in a speaker setting mode of the audio device, the at least one processor is further configured to:

transmit a test audio signal to a first speaker, among the plurality of speakers;

repeat, a predetermined number of times, an operation in which the at least one processor receives, from the microphone that has collected the test audio output by the first speaker, a signal of the output test audio, and transmits the signal of the output test audio, received by the microphone, to the first speaker; and measure, through the operation, a round-trip latency of the first speaker, and determine an output time difference between the first speaker and a second speaker among the plurality of speakers based on the measured round-trip latency of the first speaker and previously stored data on an output delay time of the second speaker.

6. The audio device according to claim 1, wherein in a speaker setting mode of the audio device, the at least one processor is further configured to:

transmit a same test audio signal to a first speaker, and a second speaker among the plurality of speakers, at an interval of a first time period;

receive, from the microphone that has collected test audio output by the first speaker and the second speaker, a signal of the output test audio; and determine a volume output difference between the first speaker and the second speaker, based on a difference between an average volume of an initial audio signal and an average volume of a later audio signal, existing after the first time period has elapsed since a starting point of the initial audio signal, in the signal of the output test audio.

7. The audio device according to claim 6, wherein the at least one processor is further configured to:

amplify an audio signal of a channel, of the multi-channel audio signal, provided to a speaker having a lower volume output among the first speaker and the second speaker, or to attenuate an audio signal of a channel, of the multi-channel audio signal, provided to a speaker having a higher volume output among the first speaker and the second speaker, so as to equalize outputs of the first speaker and the second speaker, based on the determined volume output difference between the first speaker and the second speaker.

8. An audio system for providing a multi-channel audio signal to a plurality of speakers, the audio system comprising an audio processing device and an audio recording device, wherein the audio recording device comprises:

a microphone configured to collect audio output by a plurality of speakers provided with an audio signal from the audio processing device; and a transmitter configured to transmit a signal of the collected audio to the audio processing device, and wherein the audio processing device comprises:

at least one processor configured to:

adjust a number of channels of an input audio signal based on a number of speakers connected to the audio system;

transmit the audio signal of which the number of channels has been adjusted, or a test audio signal for speaker setup, to at least one speaker among the plurality of speakers;

receive, from the audio recording device, a signal of the collected audio;

determine an output time difference between the plurality of speakers, based on the signal of the collected audio; and add an output delay signal to the audio signal of at least one channel of the multi-channel audio signal provided to the plurality of speakers so as to synchronize the outputs of the plurality of speakers, based on the determined output time difference, and wherein when the number of speakers connected to the audio system is equal to the number of channels of the input audio signal, the at least one processor bypasses the input audio signal, and when the number of speakers connected to the audio system is different from the number of channels of the input audio signal, the at least one processor upmixes or downmixes the input audio signal, so that the number of channels of the audio signal is equal to the number of speakers connected to the audio system.

9. The audio system according to claim 8, wherein the test audio signal is a signal having a specific frequency pattern, and wherein in a speaker setting mode of the audio system, the at least one processor of the audio processing device is further configured to:

transmit a same test audio signal to a first speaker and a second speaker, among the plurality of speakers;

receive, from the microphone that has collected test audio output by the first speaker and the second speaker, a signal of the output test audio; and determine an output time difference between the first speaker and the second speaker, by measuring portions in the signal of the output test audio where a signal strength of the specific frequency reaches local maximum values.

10. The audio system according to claim 8, wherein in a speaker setting mode of the audio system, the at least one processor of the audio processing device is further configured to:

transmit a same test audio signal to a first speaker and a second speaker among the plurality of speakers, at an interval of a first time period;

receive, from the microphone that has collected test audio output by the first speaker and the second speaker, a signal of the output test audio; and determine a volume output difference between the first speaker and the second speaker, based on a difference between an average volume of an initial audio signal and an average volume of a later audio signal, existing after the first time period has elapsed since a starting point of the initial audio signal, in the signal of the output test audio.

11. A method for providing a multi-channel audio signal to a plurality of speakers, performed by an audio device, the method comprising:

transmitting a test audio signal, generated for a speaker setup, to at least one speaker among the plurality of speakers;

receiving, from a microphone that has collected audio output by at least one speaker among the plurality of speakers, a signal of the output audio;

determining an output time difference between the plurality of speakers, based on the signal of the output audio;

setting an output delay buffer in at least one channel path among multi-channel paths of an audio signal provided to the plurality of speakers, so as to synchronize outputs of the plurality of speakers, based on the determined output time difference;

inputting an audio signal by the audio device; and adjusting a number of channels of the input audio signal based on a number of speakers connected to the audio device, wherein the adjusting comprises, when the number of speakers connected to the audio device is equal to the number of channels of the input audio signal, bypassing the input audio signal, and when the number of speakers connected to the audio device is different from the number of channels of the input audio signal, upmixing or downmixing the input audio signal, so that the number of channels of the audio signal is equal to the number of speakers connected to the audio device.

12. The method according to claim 11, wherein the transmitting comprises transmitting a same test audio signal to a first speaker and a second speaker, among the plurality of speakers;

the test audio signal has a specific frequency pattern;

the receiving comprises receiving, from the microphone that has collected test audio output by the first speaker and the second speaker, a signal of the output test audio; and the determining comprises determining an output time difference between the first speaker and the second speaker, by measuring portions in the signal of the output test audio where a signal strength of the specific frequency reaches local maximum values.

13. The method according to claim 12, wherein the setting comprises setting an output delay buffer in a channel path, in the multi-channel audio signal, provided to a speaker having a lower output delay among the first speaker and the second speaker, so as to synchronize outputs of the first speaker and the second speaker, based on the determined output time difference between the first speaker and the second speaker.

14. The method according to claim 11, wherein the transmitting comprises transmitting a first test audio signal to a first speaker among the plurality of speakers, and a second test audio signal to a second speaker among the plurality of speakers;

the first test audio signal has a first volume and the second test audio signal has a second volume, and the first volume and the second volume are different in level from each other;

the receiving comprises receiving, from the microphone that has collected test audio output by the first speaker and the second speaker, a signal of the output test audio; and the determining comprises determining an output time difference between the first speaker and the second speaker, by measuring a portion in the signal of the output test audio where a gain value changes.

15. The method according to claim 11, wherein the transmitting comprises transmitting a test audio signal to a first speaker, among the plurality of speakers; and the receiving the signal of the output audio comprises receiving, from the microphone that has collected test audio output by the first speaker, a signal of the output test audio, wherein, after the receiving the signal of the output audio and before the determining, the method further comprises:

retransmitting, to the first speaker, a signal of the output test audio received from the microphone; and repeating the receiving and the retransmitting a predetermined number of times, and wherein the determining the channel difference includes measuring, through the repeating the feedback receiving and the retransmitting a predetermined number of times, a round-trip latency of the first speaker, and determining an output time difference between the first speaker and a second speaker among the plurality of speakers based on the measured round-trip latency of the first speaker and previously stored data on an output delay time of the second speaker.

16. The method according to claim 11, wherein the transmitting comprises transmitting a same test audio signal to a first speaker and a second speaker among the plurality of speakers, at an interval of a first time period;

the receiving comprises receiving, from the microphone that has collected test audio output by the first speaker and the second speaker, a signal of the output test audio; and the determining comprises determining a volume output difference between the first speaker and the second speaker, based on a difference between an average volume of an initial audio signal and an average volume of a later audio signal, existing after the first time period has elapsed since a starting point of the initial audio signal, in the signal of the output test audio.

17. The method according to claim 16, wherein the setting further comprises amplifying an output of an audio signal of a channel, of the multi-channel audio signal, provided to a speaker having a lower volume output among the first speaker and the second speaker, or attenuating an output of an audio signal of a channel, of the multi-channel audio signal, provided to a speaker having a higher volume output among the first speaker and the second speaker, so as to equalize outputs of the first speaker and the second speaker, based on the determined volume output difference between the first speaker and the second speaker.

18. A non-transitory computer-readable recording medium in which at least a computer program configured to execute the method according to claim 11 is recorded.

* * * * *